US005280774A

United States Patent [19]

Entenmann et al.

[11] Patent Number: 5,280,774

[45] Date of Patent: Jan. 25, 1994

[54] FUEL INJECTION APPARATUS

[75] Inventors: Matthias Entenmann, Bietigheim-Bissingen; Stefan Meyer, Asperg, both of Fed. Rep. of Germany

[73] Assignee: Robert Bosch GmbH, Stuttgart, Fed. Rep. of Germany

[21] Appl. No.: 60,622

[22] Filed: May 14, 1993

[30] Foreign Application Priority Data

Jul. 10, 1992 [DE] Fed. Rep. of Germany ..... 4222628

[51] Int. Cl.[5] ..... F02M 69/04; F02M 69/54

[52] U.S. Cl. ..... 123/457; 123/470

[58] Field of Search ..... 123/457, 468, 469, 470

[56] References Cited

U.S. PATENT DOCUMENTS

| | | | |
|---|---|---|---|
| 4,416,238 | 11/1983 | Knapp et al. | 123/516 |
| 4,503,826 | 3/1985 | Kessler et al. | 123/470 |
| 4,905,651 | 3/1990 | Bonfiglioli et al. | 123/470 |
| 5,080,069 | 1/1992 | Hudson, Jr. | 123/470 |

OTHER PUBLICATIONS

Bosch Technical Instruction Mono-Jetronic, 1st ed. (Jun. 1991), p. 24.

*Primary Examiner*—E. Rollins Cross
*Assistant Examiner*—Thomas N. Moulis
*Attorney, Agent, or Firm*—Edwin E. Greigg; Ronald E. Greigg

[57] ABSTRACT

A known fuel injection apparatus, in which fuel and foreign matter outside the fuel injection valve can not flow past the injection valves because a flow opening is disposed between fuel supply conduit and fuel outlet conduit and of which degassing of the fuel takes place before it enters the injection valve, any foreign matter entrained in the fuel will not give rise to malfunctions in a pressure regulation. The penetration of foreign matter into the pressure regulator is prevented by means of an appropriate choice of the dimensions of the flow opening, which is provided between a filter element of the fuel injection valve and the wall of a receiving bore. The fuel injection apparatus is employed in fuel injection systems for mixture compressing internal combustion engines with externally supplied ignition.

20 Claims, 3 Drawing Sheets

FUEL INJECTION APPARATUS

BACKGROUND OF THE INVENTION

The invention is based on a fuel injection apparatus as defined hereinafter. Bosch Technical Instruction Mono-Jetronic, 1st ed. (June 1991), p. 24, describes an already known fuel injection apparatus that has at least one flow opening embodied between the fuel supply conduit and the fuel outlet conduit, outside the fuel injection valve, by means of which fuel flows and by means of which for example one degassing of the fuel to be supplied occurs before entry into the fuel injection valve; however, foreign matter entrained in the fuel, which arises for example on assembly of the fuel lines, cannot be prevented from flowing by means of the flow opening and the fuel outlet conduit, and reaching the pressure regulator, where it can give rise to malfunctions in the pressure regulation.

OBJECT AND SUMMARY OF THE INVENTION

The fuel injection apparatus according to the invention has an advantage over the prior art that foreign matter entrained with the fuel will be prevented from causing malfunctions in the pressure regulation, even though scavenging of the fuel injection valve and the degassing of the fuel is made possible thereby. This will be achieved in that foreign matter larger than a certain size, which depends upon the embodiment, cannot pass by the flow openings.

The invention will be better understood and further objects and advantages thereof will become more apparent from the ensuing detailed description of the preferred embodiments taken in conjunction with the drawings.

DESCRIPTION OF THE PREFERRED EMBODIMENTS

Figure 1:
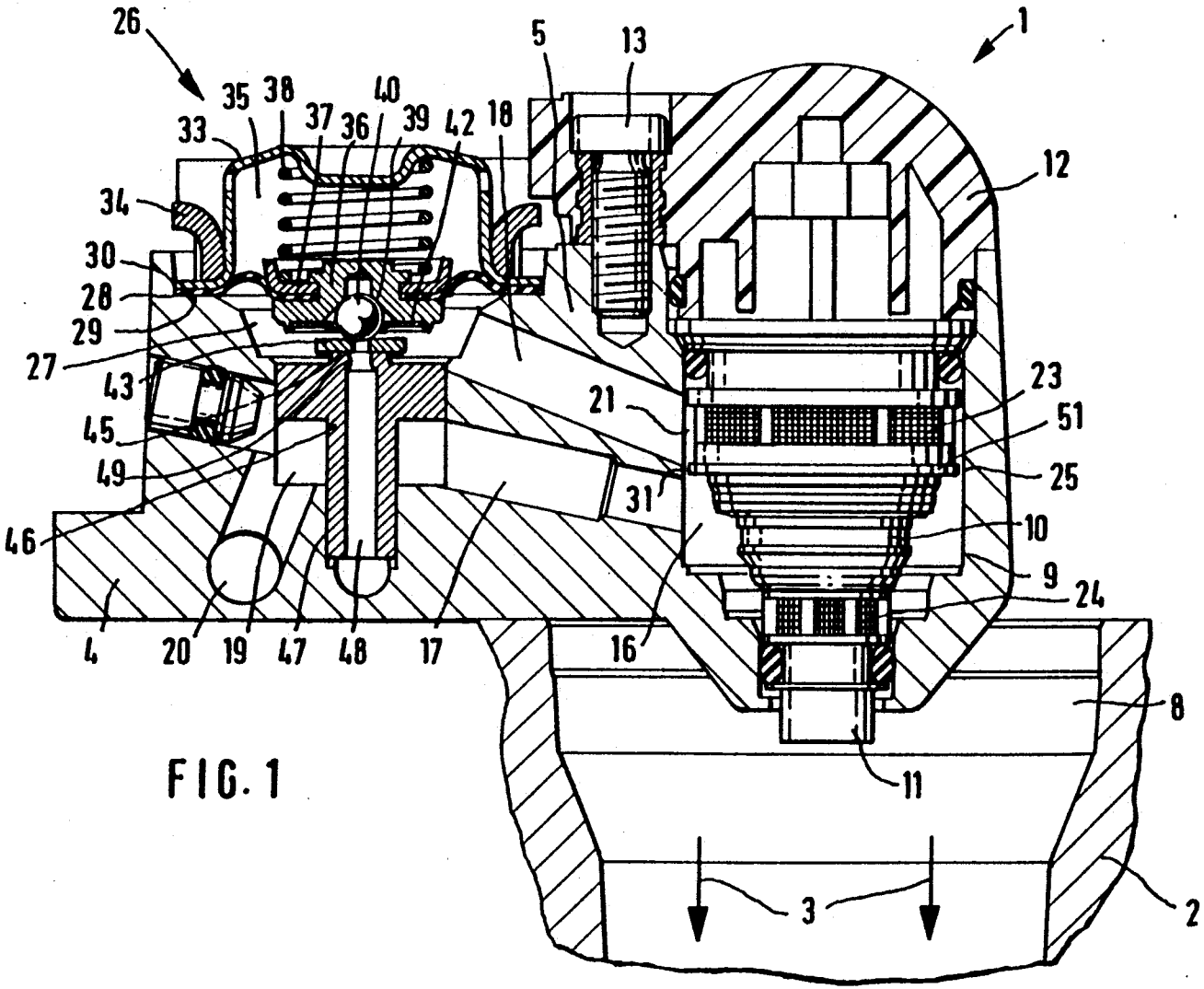
FIG. 1 shows a longitudinal section of a fuel injection apparatus.

In FIG. 1, a fuel injection apparatus, identified by reference numeral 1, contacts a throttle valve connecting piece, identified by reference numeral 2, of an air suction pipe of a mixture compressing, internal combustion engine with externally supplied ignition. The cross section of the throttle valve connecting piece 2 can be controlled by means of a throttle valve, which is actuatable in a known manner and which is not shown in FIG. 1, so that more or less air can flow into the engine via the throttle valve connecting piece 2 in the direction of the arrows 3. The fuel injection apparatus 1 has a carrier body which contacts the throttle valve connecting piece 2 upstream of the throttle valve and has at least one bridge part 5, which protrudes into a flow cross section 8 of the throttle valve connecting piece 2. The bridge part 5 has a stepped receiving bore 9 on its end that protrudes into the flow cross section 8. A fuel injection valve 10 is inserted into this receiving bore 9 concentric to the flow cross section 8 of the throttle valve connecting piece 2, and via its mouthpiece 11 fuel can be injected in the direction of the arrows 3. Remote from the mouthpiece 11, the receiving bore 9 in the carrier body 4 is covered by means of a cowl 12, which is fastened to the bridge part 5 by means of a screw 13.

A fuel supply conduit 17 and a fuel outlet conduit 18 that extend into the bridge part each feed into a fuel chamber, which is embodied by the receiving bore 9 and the fuel injection valve 10. The fuel supply conduit 17 communicates with an intermediate chamber 19, embodied in the carrier body 4, into which a connecting conduit 20 feeds, via which the fuel feed of the fuel injection apparatus takes place. Fuel ports of the fuel injection valve 10, which are not shown in the drawing, and by means of which the fuel can flow from the fuel chamber 16 into the interior of the fuel injection valve 10 or flow out from the interior of the fuel injection valve 10 into the fuel chamber 16, are encompassed by filter elements 23 and 24, which prevent foreign matter entrained in the fuel from getting into the fuel injection valve 10; filter element 23 is disposed approximately in the region of the outlets of the fuel supply conduit 17 and the fuel outlet conduit 18, and filter element 24 is disposed near the mouthpiece 11. In a further embodiment of a fuel injection apparatus, not shown in the drawing, a one-piece filter element is embodied between fuel chamber 16 and fuel injection valve 10 and both covers the fuel ports for the inflowing and outflowing fuel and at the same time prevents foreign matter from getting into the interior of the fuel injection valve 10.

At least one flow opening 25 is embodied inside the fuel chamber 16 between fuel supply conduit 17 and fuel outlet conduit 18, via which fuel from upstream of the at least one flow opening 25 outside the fuel injection valve 10 can flow downstream into the upper part 21 of the fuel chamber 16, and by means of which for example degassing of the fuel takes place. Fuel flows from the upper part 21 of the fuel chamber 16 by means of the fuel outlet conduit 18, which extends into the bridge part 5, into a compensation chamber 27 of a pressure regulator 26, which is defined by means of a diaphragm 28 whose outer edge is pressed against a shoulder 29 by a annular flange 30 of a cap 33, which is engaged by a tension ring 34, which in turn is fastened to the carrier body 4 with the aid of screws not shown in the drawing. The cap 33 encompasses an air chamber 35 which is separated from the compensation chamber 27 by means of the diaphragm 28.

An insert body 36 penetrates the diaphragm 28 and is form-fittingly connected to a spring plate 37, against which a spring 38 pushes whose other end engages the cap 33. A ball 40 is rotatably supported in a cone 39 of the insert body 36 and is held in the cone 39 by means of a retaining disk 42 and joined by material adhesion to a valve head 43, which along with the diaphragm 28 and parts 36, 37, 38, 40, and 42 comprises the movable valve part of the pressure regulator 26.

A valve seat 45 oriented toward the valve head 43 is embodied on a valve seat body 46; partially protruding into the compensation chamber 27, it is inserted into a mounting bore 47 in the carrier body 4, for example being screwed in or press-fitted into place. A return feed bore 48, extending lengthwise with reference to the valve seat body 46, has a set opening diameter 49 near a valve seat 45 and makes possible the outflow of fuel out of the compensation chamber 27 when the valve head 43 lifts off from the valve seat 45.

It has been shown that foreign matter entrained in the fuel, which is leached from the walls of the fuel lines, for example upon assembly of the fuel connections, will reach the compensation chamber 27 by means of the fuel supply conduit 17, the flow opening 25, and the fuel outlet conduit 18 and, when the valve head 43 lifts off, will get stuck there in the opening diameter 49 or the return feed bore 48 due to its geometry, causing malfunctions in the pressure regulation.

According to the invention it is therefore provided that the flow opening 25 be embodied such that foreign matter entrained in the fuel larger than a certain size dependent upon the embodiment of the flow opening 25 is trapped. The flow opening 25 in the present exemplary embodiment is embodied by means of the radial clearance between a lower rim 51 of the filter element 23 and the wall of the receiving bore 9 in the form of an annular gap 31.

Figure 2:
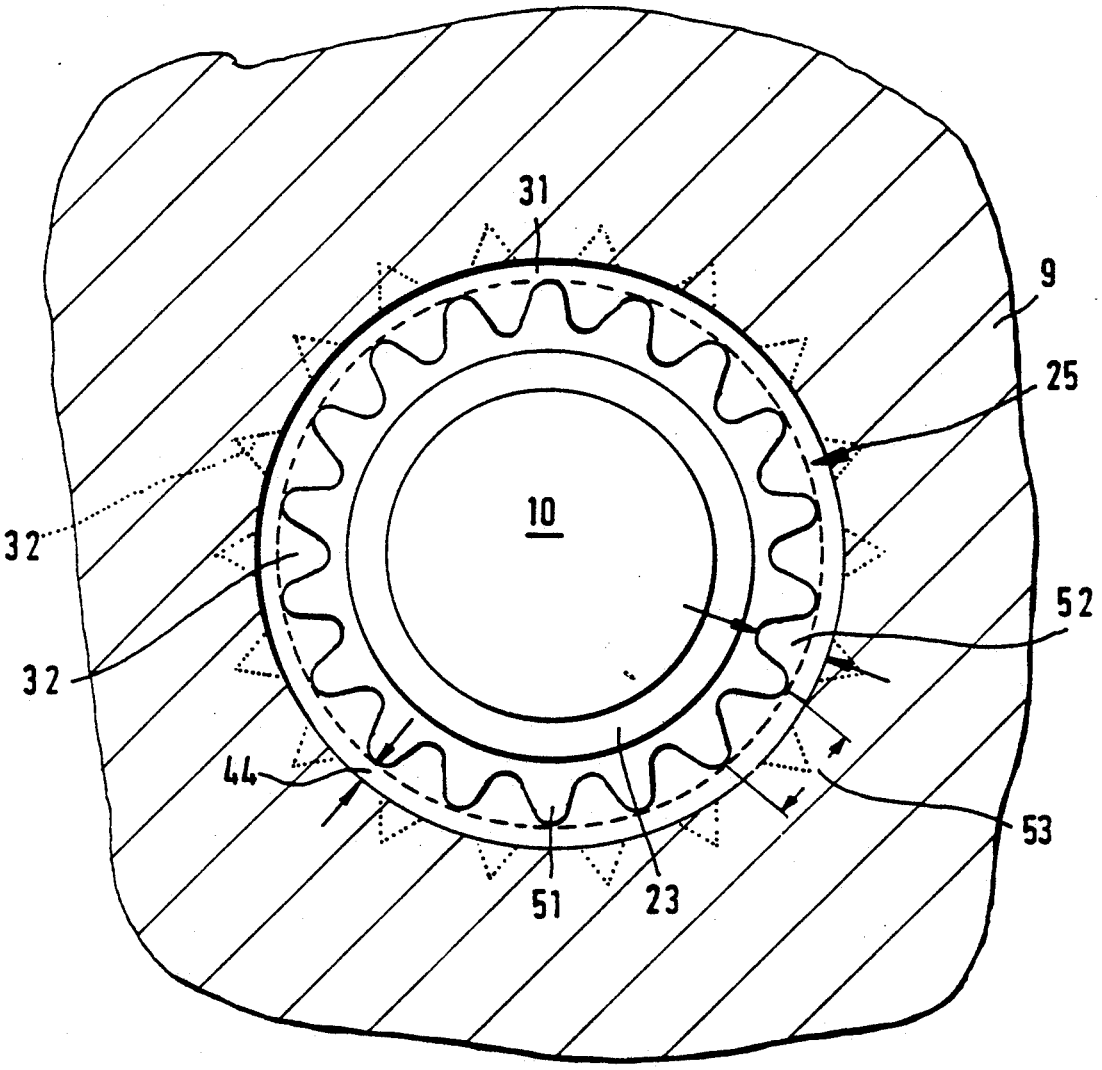
FIGS. 2 and 3 each show further exemplary embodiments of the invention.

FIG. 2 shows a further exemplary embodiment of the invention. The parts and their respective names that are the same as in the exemplary embodiment of FIG. 1 are referred to by the same reference numerals. The flow opening can be embodied not only as an annular gap 31, shown in FIG. 2 by a broken circle, but also by means of individual recesses 31, which are disposed for example in a rim 51 of the filter element 23 disposed around the injection valve 10. The flow opening 25 can also be embodied by means of a combination of an annular gap 31 and recesses 32. The recesses 32 can be embodied by means of holes in the rim 51 of the filter element 23, which are opened or closed toward the circumference of the rim 51. The rim 51 can also assume a gear-shaped embodiment. The recesses 32 can accordingly be embodied in the wall of the receiving bore 9, as shown in FIG. 2 by a dotted line. The free cross section of each recess 32 can have an arbitrary form, such as circular, oval, rectangular, trapezoidal, etc. The number of recesses 32 formed is fixed by the fuel quantity desired to flow through the fuel injection valve 10.

In order to prevent foreign matter entrained in the fuel from flowing from the fuel supply conduit 17 via the flow opening 25 and the fuel outlet conduit 18 and reaching the pressure regulator 26 and bringing about malfunctions in the pressure regulation, the annular gap 31 forming the flow opening 25 has a radial width 44, which at most is exactly as large as the opening diameter 49 of the return bore 48 of the pressure regulator 26, and the flow openings 25 embodied as recesses, possibly including an annular gap, have dimensions such as radially, a maximum depth 52 starting from the wall of the receiving bore 9 and circumferentially, a maximum width 53, each of which at most is exactly as large as the opening diameter 49 of the return bore 48 of the pressure regulator 26.

Figure 3:
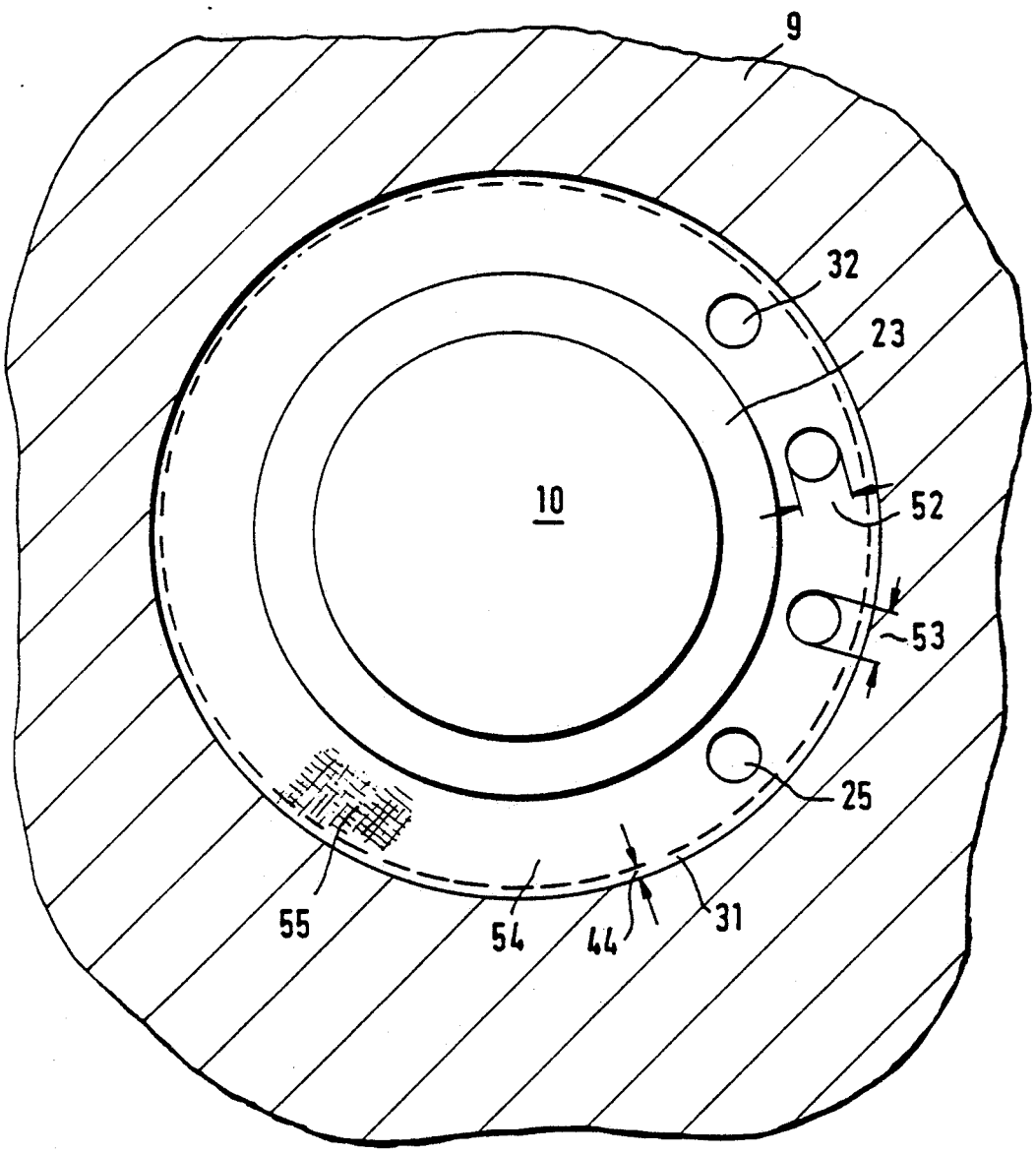

FIG. 3 shows a further exemplary embodiment. The parts and their respective names that are the same as in FIGS. 1 and 2 are referred to by the same reference numerals. The flow openings 25 are embodied as recesses 32 in an annular body 54 disposed between the wall of the receiving bore 9 and the filter element 23 or directly at the circumference of the fuel injection valve 10, and they have dimensions which at most are exactly as large as the opening diameter 49 of the return bore 48 of the pressure regulator 48. The form of the recesses corresponds to the forms described in FIG. 2. FIG. 3 shows ring-shaped recesses. In a further embodiment, the annular body 54 is provided with a radially extending filter material 55 that traps at least all foreign matter which is larger than the opening diameter 49 of the return bore 48 of the pressure regulator 26. As is already described in conjunction with FIG. 2, the exemplary embodiments according to FIG. 3 can also be provided with an additional annular gap 31 between the rim of the annular body 54 and the wall of the receiving bore 9, whose radial width 44 is at most exactly as large as the opening diameter 49 of the return bore 48 of the pressure regulator 26.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection apparatus for a mixture compressing internal combustion engine with externally supplied ignition, having a carrier body in which at least one receiving bore is embodied that communicates with at least one fuel supply conduit and at least one fuel outlet conduit and into each receiving bore one fuel injection valve is inserted, wherein a filter element is disposed on the fuel injection valve, said filter element has a rim that extends toward a wall of the receiving bore and defines a region connected with the fuel supply conduit, wherein on the rim of the filter element at least one flow opening is provided, via which the fuel can flow from the fuel supply conduit to the fuel outlet conduit and from there to a return bore of a pressure regulator, which bore has a defined opening diameter, the at least one flow opening (25, 31, 32) has dimensions which at most are exactly as large as the opening diameter (49) of the return bore (48) of the pressure regulator (26).

2. A fuel injection apparatus as defined by claim 1, in which starting radially at a wall of the receiving bore (9) the at least one flow opening (25, 31, 32) has a maximum depth (52), which at most is exactly as large as the opening diameter (49) of the return bore (48) of the pressure regulator (26).

3. A fuel injection apparatus as defined by claim 1, in which flow opening (25, 31, 32) is embodied in the rim (51) of the filter element (23).

4. A fuel injection apparatus as defined by claim 1, in which flow openings (25) are embodied as recesses (32) that are open toward a circumference of the rim (51).

5. A fuel injection apparatus as defined by claim 4, in which the rim (51) is gear-shaped in embodiment.

6. A fuel injection apparatus as defined by claim 1, in which the flow openings (25) are embodied in the wall of the receiving bore (9).

7. A fuel injection apparatus as defined by claim 2, in which each flow opening (25, 32) has a maximum width (53), which at most is exactly as large as the opening diameter (49) of the return bore (48) of the pressure regulator (26).

8. A fuel injection apparatus as defined by claim 1, in which an annular gap (31) is embodied between the rim (51) of the filter element (23) and the wall of the receiving bore (9).

9. A fuel injection apparatus for a mixture compressing internal combustion engine with externally supplied ignition, having a carrier body, in which at least one receiving bore is embodied that communicates with at least one fuel supply conduit and at least one fuel outlet conduit, and into each said receiving bore one fuel injection valve having at least one filter element is inserted, and a region of the receiving bore that communicates with the fuel supply conduit is delimited from the region communicating with the fuel outlet conduit, and these areas communicate with one another via at least one flow opening, via which fuel from the fuel supply conduit can flow past the fuel injection valve, and from there to a return bore (48) with a defined opening diameter, this return bore (48) belonging to a pressure regulator, the region of the receiving bore that communicates with the fuel supply conduit (17) is delimited from the region that communicates with the fuel outlet conduit (18) by means of a separate annular body (54), which is disposed between the wall of the receiving bore (9) and the fuel injection valve (10) and in which the flow openings (25) are embodied, which openings have dimensions which at most are exactly as large as the opening diameter (49) of the return bore (48) of the pressure regulator (26).

10. A fuel injection apparatus as defined by claim 9, in which starting radially at a wall of the receiving bore (9) the flow openings (25) have a maximum depth (52), which at most is exactly as large as the opening diameter (49) of the return bore (48) of the pressure regulator (26).

11. A fuel injection apparatus as defined by claim 10, in which the flow openings (25) are embodied as recesses (32) that are open toward a circumference of a lower rim (51) of a filter element.

12. A fuel injection apparatus as defined by claim 11, in which the rim of the annular body (54) is gear-shaped in embodiment.

13. A fuel injection apparatus as defined by claim 11, in which starting radially at the wall of the receiving bore (9) the flow openings (25) have a maximum depth (52), which at most is exactly as large as the opening diameter (49) of the return bore (48) of the pressure regulator (26).

14. A fuel injection apparatus as defined by claim 12, in which starting radially at the wall of the receiving bore (9) the flow openings (25) have a maximum depth (52), which at most is exactly as large as the opening diameter (49) of the return bore (48) of the pressure regulator (26).

15. A fuel injection apparatus as defined by claim 9, in which the annular body (54) is provided with a filter material (55).

16. A fuel injection apparatus as defined by claim 9, in which an annular gap (31) is embodied between the rim of the annular body (54) and the wall of the receiving bore (9).

17. A fuel injection apparatus as defined by claim 10, in which an annular gap (31) is embodied between the rim of the annular body (54) and the wall of the receiving bore (9).

18. A fuel injection apparatus as defined by claim 11, in which an annular gap (31) is embodied between the rim of the annular body (54) and the wall of the receiving bore (9).

19. A fuel injection apparatus as defined by claim 12, in which an annular gap (31) is embodied between the rim of the annular body (54) and the wall of the receiving bore (9).

20. A fuel injection apparatus as defined by claim 13, in which an annular gap (31) is embodied between the rim of the annular body (54) and the wall of the receiving bore (9).

* * * * *